US006405498B1

(12) United States Patent
Riegelman

(10) Patent No.: US 6,405,498 B1
(45) Date of Patent: Jun. 18, 2002

(54) INSULATING GLASS SPACER CHANNEL SEAL

(76) Inventor: Harry M. Riegelman, 9013 Mill Valley Cir. Apt. 178, Ft. Worth, TX (US) 76120

( * ) Notice: Subject to any disclaimer, the term of this patent is extended or adjusted under 35 U.S.C. 154(b) by 0 days.

(21) Appl. No.: 09/516,810

(22) Filed: Mar. 1, 2000

(51) Int. Cl.[7] ..... E06B 7/16

(52) U.S. Cl. ..... 52/204.595; 52/171.3; 52/172; 52/204.71; 52/656.6; 52/658

(58) Field of Search ..... 52/171.3, 172, 52/232, 204.593, 204.595, 204.71, 717.02, 717.05, 307.3, 786.11, 786.13, 738.1, 658, 656.6

(56) References Cited

U.S. PATENT DOCUMENTS

| | | | | | |
|---|---|---|---|---|---|
| 2,312,721 | A | * | 3/1943 | Lang | |
| 3,280,523 | A | | 10/1966 | Stroud et al. | |
| 3,442,059 | A | * | 5/1969 | Kessler | |
| 3,994,109 | A | | 11/1976 | Pandell | |
| 4,357,744 | A | * | 11/1982 | McKenzie et al. | 29/451 |
| 4,587,784 | A | | 5/1986 | Chavy et al. | |
| 4,628,582 | A | * | 12/1986 | Leopold | 29/451 |
| 5,111,618 | A | | 5/1992 | Kasper et al. | |
| 5,255,481 | A | | 10/1993 | Misera et al. | |
| 5,351,451 | A | * | 10/1994 | Misera et al. | 52/172 |
| 5,361,476 | A | * | 11/1994 | Leopold | 29/417 |
| 5,424,111 | A | | 6/1995 | Farbstein | |
| 5,501,013 | A | * | 3/1996 | Misera et al. | 29/897.312 |
| 5,503,884 | A | * | 4/1996 | Meyer et al. | 428/34 |
| 5,531,047 | A | * | 7/1996 | Leopold et al. | 52/172 |
| 5,617,695 | A | * | 4/1997 | Brimmer | 52/717.02 |
| 5,640,828 | A | * | 6/1997 | Reeves et al. | 52/786.13 |
| 5,655,282 | A | * | 8/1997 | Hodek et al. | 29/469.5 |
| 5,761,946 | A | * | 6/1998 | Misera et al. | 72/181 |
| 5,873,203 | A | * | 2/1999 | Thiel | 52/172 |
| 6,038,825 | A | * | 3/2000 | Shah et al. | 52/172 |
| 6,109,331 | A | * | 8/2000 | Story, Jr. | 160/371 |
| 6,223,414 | B1 | * | 5/2001 | Hodek et al. | 29/527.1 |
| 6,279,292 | B1 | * | 8/2001 | Shah et al. | 52/786.13 |
| 6,354,052 | B1 | * | 3/2002 | Guinet | 52/363.5 |

* cited by examiner

*Primary Examiner*—Carl D. Friedman
*Assistant Examiner*—Yvonne M. Horton
(74) *Attorney, Agent, or Firm*—Robert A. Seemann

(57) ABSTRACT

A cutout is made on the front wall of a substantially straight portion of spacer frame channel, having an apex at the axis of bend of the channel for making a corner of the frame, the edges of the cutout being angled so that they close down to a slot of at least 4 degrees opening when the channel bent on the axis to make the corner, sealant is applied on the front wall of the straight portion across the cutout before bending into a corner.

11 Claims, 3 Drawing Sheets

INSULATING GLASS SPACER CHANNEL SEAL

BACKGROUND OF THE INVENTION

1. Field of the Invention

The invention pertains to spacer frame channel that is installed between glass plates along the periphery of a sealed insulating glass unit, more specifically to hermetically sealing the corners of the frame.

2. Description of the Prior Art

The prior art is replete with designs for sealing corners of a spacer frame.

In a spacer frame made from channel stock, a series of V cutout pairs are made on each side of a flat strip for forming a corner in the spacer frame when the strip is roll formed into a channel and the channel is bent on a transverse axis that passes through the apexes of the V-cuts to make the corner. The transverse axis is generally perpendicular to the length or longitudinal axis of the channel. The pairs of V-cuts are spaced from one another along the length of the channel so that each transverse axis is the bend axis for making a corner of the spacer frame.

The V-cut angle is made at 90 degrees so that when the channel is bent on the transverse axis through the apexes, the edges of the V abut parallel against one another. The edges are sometimes welded together. Sealant is applied over the abutting joint outside the joint on the outside of the channel, and in some applications additionally over the abutting joint outside the joint on the inside of the channel. In another prior art design, the V-cut angle is made at less than 90 degrees so that the edges overlap and can be spot welded or bonded. And then sealant is placed over the bonded edges.

U.S. Pat. No. 3,994,109 patented Nov. 30, 1976 by R. Pandell describes hollow straight rails which are miter cut under an angle of 45 degrees and joined so that the inclined surfaces of the cuts abut each other to form a corner of a spacer frame. Legs of an angular plastic insert or connecting member holds the rails together at the corner. The outer corner of the connecting member is angled to form a chamber with the inner wall of the rail. Sealant is injected through a hole in the spacer frame to fill the chamber which seals the corner. A second hole may be provided that faces one of the window panes for controlling filling of the chamber, indicating the chamber is full when the sealant is pressed against the pane.

U.S. Pat. No. 5,255,481 patented Oct. 26, 1993 by Misera et al., describes a spacer channel in which front and back sides of the channel have inward folds so that the apexes of the inward folds are at the bend axis of the strip for making the corner. Sealant is applied to the outside of the spacer frame at the corner of the frame to fill in the space between the fold crease and the glass.

SUMMARY OF THE INVENTION

It is one object of the invention to provide a spacer frame that can be coated continuously on the outside with sealant including over the V cutout at the transverse bend axis for the corner of the spacer frame before the strip is bent or folded, to make the corner.

It is another object of the invention to provide spacer frame channel that moves sealant into the corner joint when bent to make the corner of the frame.

A spacer frame for separating window panes to form an insulated window, having a front first wall, a back second wall spaced from the first wall, and the first wall forming a corner of the frame, comprises a slot through the first wall at the corner extending from the apex of the corner toward the inside of the frame, and first sealant on the first wall, extending into the slot.

A third wall connected to and substantially normal to the first wall has a bend that forms the corner, and includes a second sealant on the third wall between the first wall and the second wall, that extends through the slot in contact with the first sealant.

Another spacer frame of the invention has a front first wall, a back second wall spaced from the first wall, the first wall forming a corner of the frame, the spacer frame including a slot through the first wall at the corner extending from the apex of the corner toward the inside of the frame, the slot being open to an angle of at least 4 degrees.

A method of sealing a spacer frame corner includes applying sealant across an angled cutout on a first wall of the channel of the frame, the cutout having an apex substantially at the axis of bend of the channel for forming the corner of the frame, applying the sealant before bending the channel to make the corner of the frame.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
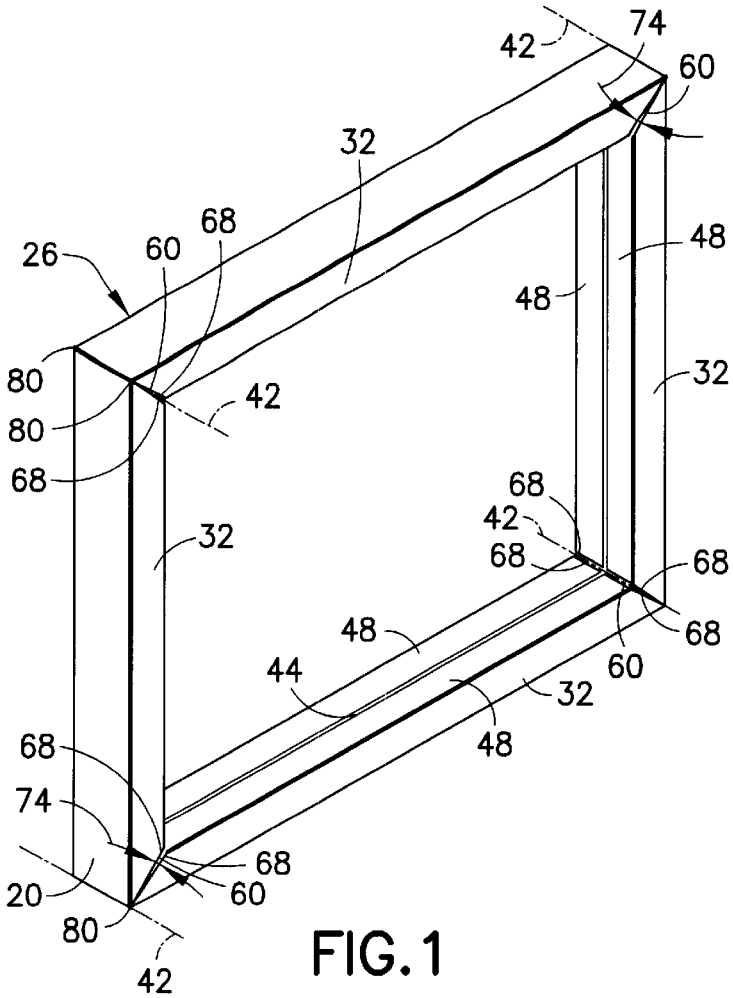
FIG. 1 is a perspective view of a spacer frame of the invention before sealant is applied.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Figure 2:
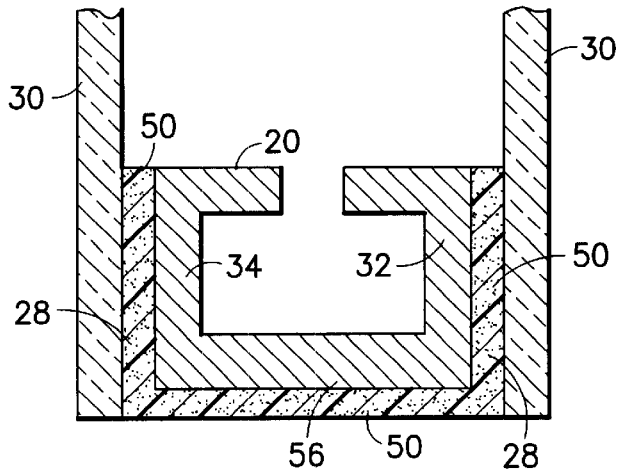
FIG. 2 is a cross section view of the spacer frame of FIG. 1 between two corners, with outside sealant and glass in place.
Figure 3:
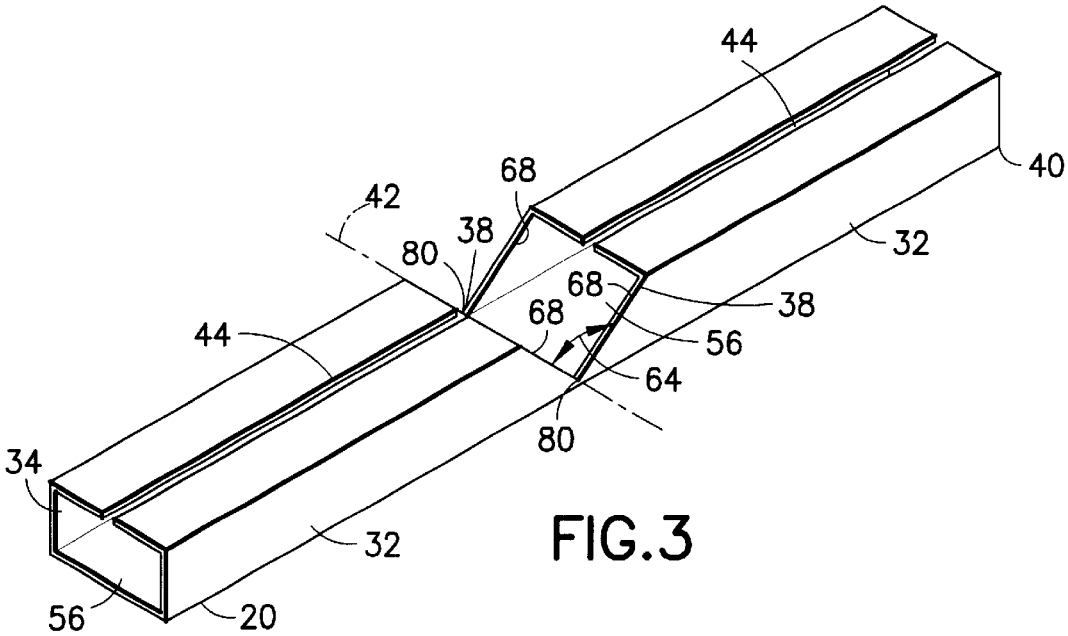
FIG. 3 is a perspective view of a length of V-cut channel of the invention before it is bent to make a corner of a spacer frame.

Referring to FIGS. 1–3, channel 20 of frame 26 is sealed 28 between panes of glass 30 along front and back walls 32, 34 of frame 26.

Before the strip of metal which forms channel 20 is roll formed in to the channel shape, the strip is cut so that V 38 is formed in the roll formed straight channel stock 40.

The strip is then roll formed into channel stock 40 with narrow longitudinal slot 44.

Channel stock 40 is then bent on transverse axis 42 at each V 38 into frame 26 with narrow longitudinal opening 44 being on inner wall 48 of frame 26. The corner bend reduces the width of cutout V 38 to form slot 60.

V 38 is cut out at an angle 64 of 100 degrees between edges 68 of the V so that when the channel is bent to a 90 degree corner, angle 74 of the gap between edges 68 of slot 60 is about 10 degrees.

Preferably the angle of V 38 is made so that angle 74 of slot 60 opening is no smaller than 4 degrees. Given a 90 degree corner bend, the angle of V 38 would be about 94 degrees.

The opening of slot 60 is made sufficiently large to allow sealant material to flow through the slot for at least half the length of slot 60 starting at the bottom of the slot which is at the apex end of the slot.

After the channel is roll formed, sealant is applied to the outside and to the inside of the channel. Preferably sealant is applied to the outside before it is applied to the inside.

Figure 5:
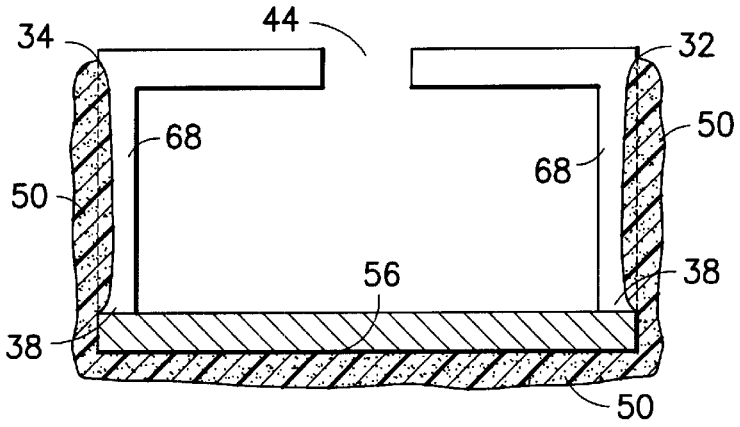
FIG. 5 is a cross section schematic view of the channel of FIG. 3, having sealant in place on the edges of the V-cuts, and on the outside of the channel before bending of the channel into a corner.

Referring to FIG. 5, sealant 50 is applied continuously along the length of the outside of the channel on front wall 32, on back wall 34, and preferably on connecting outer wall 56. Preferably the sealant extends onto edges 68 of V cutout 38. Sealant 50 is preferably semi-viscous. Hot-melt butyl is one type that can be used. Other sealants may be used.

Figure 4:
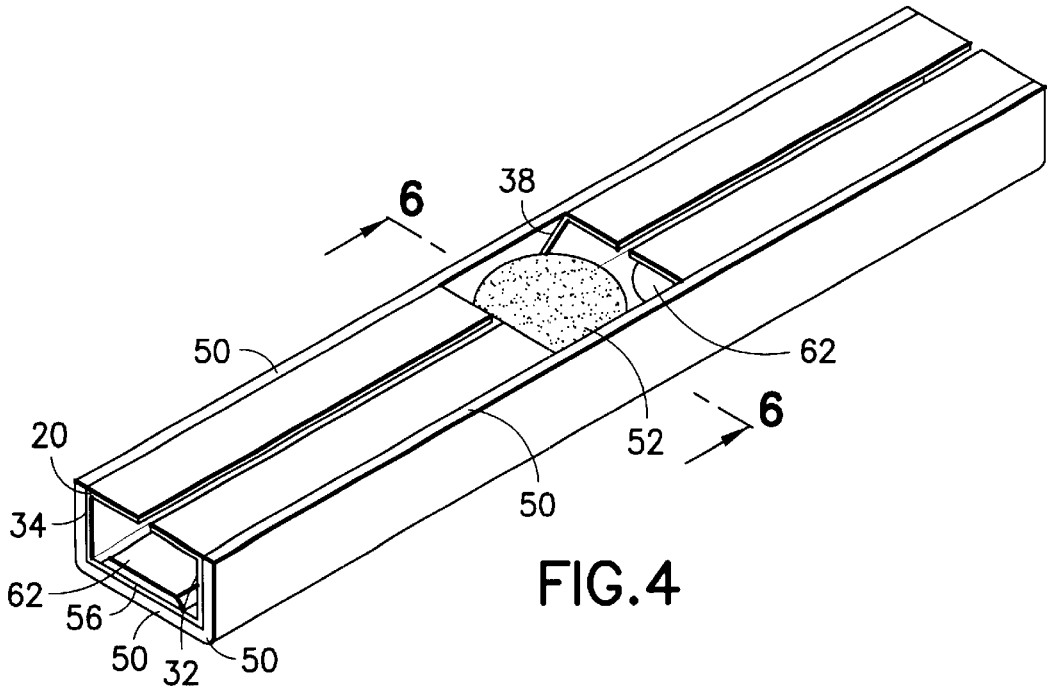
FIG. 4 is a perspective view of the channel of FIG. 3, having sealant in place before bending of the channel into a corner.
Figure 6:
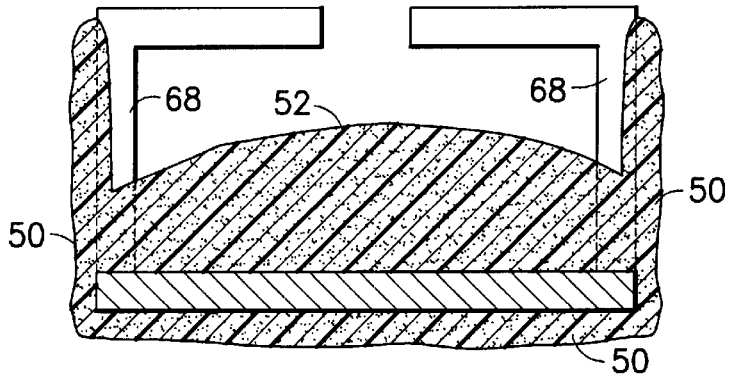
FIG. 6 is a cross section view of the channel of FIG. 4 taken along 6—6 at the transverse axis that is through the apexes of the V-cuts.

Referring to FIGS. 4 and 6, sealant 50 is applied outside the channel as in FIG. 5. Inside the channel, sealant 52 is applied on transverse axis 42 that passes through the apexes 80 of the V cutouts. Either one or both of sealants 50 and 52 extend preferably onto edges 68.

Figure 7:
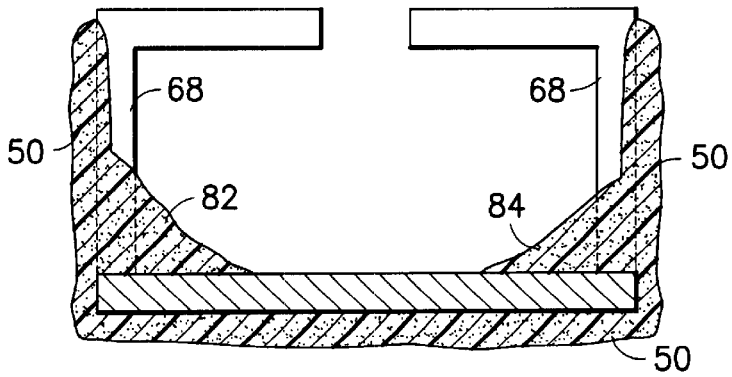
FIG. 7 is a cross section view of the channel of FIG. 3, additionally having sealant in place at the transverse axis that is through the apexes of the V-cuts, on the inside and on the outside of the channel before bending the channel into a corner.

Referring to FIG. 7, sealant 50 is applied outside the channel. Inside the channel sealants 82, 84 are applied in blobs on each side of the inside of the channel, on transverse axis 42, so that sealant extends onto edges 68.

Sealants 50, 52, 82, and 84 are preferably semi-viscous. They are preferably the same material.

If the sealant is not applied directly to the edges, sufficient sealant is put in place in the channel so that when the channel is bent on the transverse axis to make the corner, the sealant is squeezed by the closing angle of the bend in outer wall 56, into slot 60 preferably as high as half of the height of the slot taken from the vertex of the slot.

Preferably, the opening of the slot large is enough so that sealant applied on the outside of the channel, and inside the channel bond through the slot for at least half of the height of the slot starting at the bottom closed end, or apex of the slot.

Before bending the corner, preferably the sealant is applied to the outside of the channel before it is applied to the inside of the channel at the transverse axis, so that the sealant on the outside is a lateral stop against loss of the sealant from the inside through the V when the channel is bent on the transverse axis.

Preferably a sufficient amount of sealant is applied to one or both of the inside of the channel and the outside of the channel so that the inside sealant is in contact with the outside sealant through the slot.

When heat and pressure is applied to permanently seal the peripheries of the two glass plates to frame 26 that is between them, excess sealant 50 is forced into slot 60. Sealant 50 bonds to the enclosing glass and to sealant from within the channel through slots 60.

Desiccant 62 is also installed in the channel. The desiccant is not a part of the invention.

While the preferred embodiment of the invention has been shown and described, it will be understood that the invention may be embodied otherwise than as herein specifically illustrated or described, and that certain changes in form and arrangement of parts and in the specific manner of practicing the invention may be made without departing from the underlying idea or principles of this invention within the scope of the appended claims.

DRAWING DESIGNATORS (INFORMAL LIST)

20 channel
26 frame
28 sealed
30 pane of glass
32 front wall
34 back wall
38 V-cutout
40 channel stock
42 transverse axis
44 longitudinal opening
48 inner wall of frame
50 semi-viscous sealant
52 semi-viscous sealant
56 outer wall, connecting
60 slot
62 desiccant
64 angle of V
68 edges of V and of slot
74 angle of slot
80 apex of V 38
82 sealant
84 sealant

What is claimed is:

1. A spacer frame for separating window panes to form an insulated window, having a front first wall, a back second wall spaced from said first wall, said first wall comprising a corner of said frame, said spacer frame comprising:

a slot through said first wall at said corner extending from the apex of said corner toward the inside of said frame, first sealant on said first wall, extending into said slot, a third wall substantially normal to said first wall, extending in one piece from said first wall on first and second sides of said corner, a bend in said third wall forming said corner, second sealant on said third wall between said first wall and said second wall, extending through said slot in contact with said first sealant.

2. The spacer frame of claim 1, further comprising:

said slot being open to an angle of at least 4 degrees.

3. The spacer frame of claim 1, further comprising:

said first sealant extending in said slot to at least half the height of said slot from the apex of said slot.

4. The spacer frame of claim 1 further comprising:

the first wall, second wall and third wall forming a channel that extends in two legs from said corner, said channel being open continuously through said corner into both legs.

5. A channel for a spacer frame for separating window panes to form an insulated window, said channel having a front first wall, a back second wall spaced from said first wall, a bending axis transverse to said first wall and said second wall for bending said channel into a corner of the frame, said channel comprising:

on a substantially straight portion of said channel, a cutout on said first wall, having an apex substantially at said axis and edges angled from one another so that they form an open slot between them when the channel is bent on said axis for forming a corner of said frame.

6. The channel of claim 5, further comprising:

sealant on at least one of said edges configured so that it is in said slot between said edges when said channel is bent on said bending axis.

7. The channel of claim 5, further comprising sealant on said first wall, extending across said cutout.

8. The channel of claim 5, further comprising:

a third wall comprising said bending axis, connected to and substantially normal to said first wall, first sealant on said third wall at the bending axis between said first wall and said second wall, extending into said cutout.

9. The channel of claim 5, further comprising:

a third wall comprising said bending axis, connected to and substantially normal to said first wall, a sufficient amount of first sealant on said third wall at the bending axis so that said sealant moves along at least one of said edges when said third wall is bent to form a corner of said frame.

10. A spacer frame for separating window panes to form an insulated window, having a front first wall, a back second wall spaced from said first wall, said first wall comprising a corner of said frame, said spacer frame comprising:

a slot through said first wall at said corner extending from the apex of said corner toward the inside of said frame, a third wall substantially normal to said first wall, extending in one piece from said first wall on first and second sides of said corner, a bend in said third wall forming said corner, first sealant on said third wall between said first wall and said second wall, extending through said slot.

11. The spacer channel of claim 10 further comprising:

the first wall, second wall and third wall forming a channel that extends in two legs from said corner, said channel being open continuously through the corner into both legs.

* * * * *